US005278941A

United States Patent [19]

Ward

[11] Patent Number: 5,278,941

[45] Date of Patent: Jan. 11, 1994

[54] ELECTRIC IMMERSION HEATER WITH RESTRICTED HEAT-FLOW PATHS TO THE THERMOSTATIC CONTROL THEREOF

[76] Inventor: Richard E. Ward, 11040 4A Rd., Plymouth, Ind. 46563

[21] Appl. No.: 895,318

[22] Filed: Jun. 8, 1992

[51] Int. Cl.[5] ..... H05B 1/02; H05B 3/80; F24H 1/06

[52] U.S. Cl. ..... 392/498; 119/73; 219/523; 219/530; 219/540; 392/444; 392/447

[58] Field of Search ..... 392/498-582, 444, 447; 219/523, 530, 540; 119/73

[56] References Cited

U.S. PATENT DOCUMENTS

| | | | |
|---|---|---|---|
| 2,389,925 | 11/1945 | Morgan et al. | 219/523 X |
| 2,430,272 | 11/1947 | Brodie . | |
| 2,432,169 | 12/1947 | Morgan et al. | 219/523 X |
| 2,437,262 | 3/1948 | Levitt et al. | 219/500 X |
| 2,454,091 | 11/1948 | Rietz . | |
| 2,472,178 | 6/1949 | Temple . | |
| 2,561,932 | 7/1951 | Landgraf . | |
| 2,977,454 | 3/1961 | Volker | 392/500 |
| 3,497,677 | 2/1970 | Blain | 219/523 |
| 4,068,116 | 1/1978 | McKinstry | 219/523 |
| 4,358,667 | 11/1982 | Johnson et al. | 219/523 X |
| 4,599,973 | 7/1986 | Ward | 219/523 X |
| 4,835,366 | 5/1989 | Owen et al. | 392/499 |

FOREIGN PATENT DOCUMENTS

| | | | |
|---|---|---|---|
| 590131 | 12/1933 | Fed. Rep. of Germany | 392/498 |
| 1145994 | 3/1969 | United Kingdom | 392/498 |

*Primary Examiner*—Anthony Bartis
*Attorney, Agent, or Firm*—Wendell E. Miller

[57] ABSTRACT

An electric immersion heater (10) is provided for heating fluids, such as water in a livestock watering tank. The electric heater includes a heater subassembly (26), a protective cover (39), and a power cord (21) having a power plug (24). The heater subassembly (26) includes a heating element (14) having first and second ends (16A and 16B) and a molded metallic case (12 or 12A) enclosing the heating element (14). The protective cover (39) encloses and hermetically seals the operative connection of a thermostatic switch (18), the first and second ends (16A and 16B) of the heating element (14), and first, second, and third conductors (22A-22C) of the power cord (21). The thermostatic switch (18) is bonded in heat-receiving proximity to the molded case (12 or 12A). Potting compound (38) disposed intermediate of the thermostatic switch (18) and the fluid to be heated is provided as a thermal barrier for restricting the heat flow from the fluid to the thermostatic switch (18). An elongated slot, recess, opening, or passageway (82) disposed in the molded case (12 or 12A) intermediate of the heating element (14) and the thermostatic switch (18), is provided as a barrier for reducing the rate of heat transferred to the thermostatic switch (18) from the heating element (14). In addition, the elongated slot, recess, opening, or passageway (82) provides means for transmitting heat to the fluid causing a cooling effect on the thermostatic switch (18).

17 Claims, 2 Drawing Sheets

ELECTRIC IMMERSION HEATER WITH RESTRICTED HEAT-FLOW PATHS TO THE THERMOSTATIC CONTROL THEREOF

BACKGROUND OF THE INVENTION

1. Field of the Invention

The present invention relates generally to electric heaters for fluids. More particularly, the present invention relates to apparatus and method for heating water in livestock watering tanks and in other containers.

2. Description of the Related Art

Electric heaters for livestocks watering tanks have been of several general types. One type has been the submerged heater that rests on the bottom of the watering tank. Another type has been the floating water heater. Other designs have been fastened or otherwise physically located with respect to the bottom of the tank.

Limitations of the prior art have included exposed heating elements that are subject to physical damage, inadequate thermal protection, and/or large geometric features. Such characteristics pose a threat of fire hazard, a threat of injury to livestock, a threat of unit damage, or tank size limitations.

Typical of the floating type are the units which are described by Landgraf in U.S. Pat. No. 2,561,932, issued Jul. 24, 1951; Brodie in U.S. Pat. No. 2,430,272, issued Nov. 4, 1947; Reitz in U.S. Pat. No. 2,454,091, issued Nov. 16, 1948; and Temple in U.S. Pat. No. 2,472,178, issued Jun. 7, 1949.

McKinstry, in U.S. Pat. No. 4,068,116, issued Jan. 10, 1978, greatly reduced the fire hazard by using a metallic strip to provide a heat flow path from the heating element to the thermostat. When submerged in water, because of water cooling the metallic strip, the metallic strip was relatively ineffective in transmitting heat from the heating element to the thermostat so that the thermostat was largely controlled by water temperature. However, upon occasions wherein an animal tossed the electric heater out of the water tank and into a pile of hay or straw, the metallic strip conducted the heat of the heating element to the thermostat rapidly, thereby avoiding overheating of the heating element and a fire hazard. Owen et al., in U.S. Pat. No. 4,835,366, issued May 30, 1989, improved on the electric heater of McKinstry by extending an end of the metallic strip of McKinstry, thereby providing additional cooling of the thermostat when the heating element is submerged in water.

Ward, in U.S. Pat. No. 4,599,973, issued Jul, 15, 1986, provided both floating and submerged electric heaters with the safety of McKinstry but with superior durability, reduced watt density, and more accurate sensing of the temperature of the heating element.

Accuracy, as it pertains to thermostatic control of electric heaters of the type discussed herein, does not mean that the thermostat turns off the electric heater at the temperature at which the temperature of the heating element equals the temperature setting of the thermostatic switch. Instead, accuracy refers to repeatability, the ability to accurately sense a temperature relationship, between the heating element and the thermostatic switch, under given conditions of immersion and/or non-immersion.

In spite of the advances made heretofore, none of the prior art has provided an electric heater which includes accuracy of sensing of the temperature of the heating element, durability of construction with the resultant freedom from accidental damage, and ultracompact design for use in small containers.

SUMMARY OF THE INVENTION

In the present invention, an electric heater includes an elongated heating element that is coiled and generally circular with two ends proximal to one another, a molded aluminum case that encloses the heating element except for the ends thereof, a thermostatic switch that is bonded to the case in heat-transmitting proximity thereto and that is electrically connected in series with the heating element, a power cord that is connected to the thermostatic switch and the heating element, and a potted protective cover that seals the thermostatic switch and reduced thermal conductivity between a fluid and the thermostatic switch.

In order to achieve an ultracompact design, and also to provide adequate moisture resistance, the power cord should be at one end, the heating element should be disposed in a circular or spiral pattern distal from the power cord, and the thermostatic switch should be interposed between the power cord and the heating element.

A slot is disposed in the molded case intermediate of the heating element and the thermostatic switch. The slot provides a barrier to heat transfer from the heating element to the thermostatic switch, thus reducing the rate of heat transfer from the heating element to the thermostatic switch, thereby at least partially overcoming excessive control of the thermostatic switch by the heating element as caused by the potted protective cover and the resultant reduction in thermal conductivity between the thermostatic switch and the water. In addition, the slot provides means for transmitting heat from the thermostatic switch to the fluid, thus negating a portion of the heat transferred from the heating element to the thermostatic switch, thereby further overcoming excess heating of the thermostatic switch by the heating element as caused by the potted thermostatic cover and the resultant reduction in thermal conductivity between the thermostatic switch and the water.

It is a first object of the present invention to provide an ultracompact electric water heater for watering farm animals, and for various other uses, that may be disposed into containers as small as a bucket.

It is a second object of the present invention to provide an ultracompact electric water heater by securing a thermostatic switch against a molded body that contains a coiled heating element.

It is a third object of the present invention to provide an electric water heater that is both ultracompact and environmentally reliable by juxtaposing a thermostatic switch against the molded body of a heating element, and potting both the thermostatic switch and electric connections to the heating element.

It is a fourth object of the present invention to provide an electric water heater that is ultracompact, environmentally reliable, and accurate in thermostatic control by juxtaposing a thermostatic switch against a molded body of a heating element, encasing the thermostatic switch in a potting compound, and providing a heat-flow barrier between the thermostatic switch and the heating element to compensate for reduced heat flow from the thermostatic switch to water as caused by the potting compound.

It is a fifth object of the present invention to provide an electric water heater in which a thermostatic switch is juxtaposed against a molded body with a heating element, heat flow from the thermostatic switch to water is reduced by a potting compound, and a heat-flow barrier is placed between the heating element and the thermostatic switch to at least partially overcome the effect of the reduced heat flow from the thermostatic switch to the water.

DESCRIPTION OF THE PREFERRED EMBODIMENTS

Figures 1, 2:
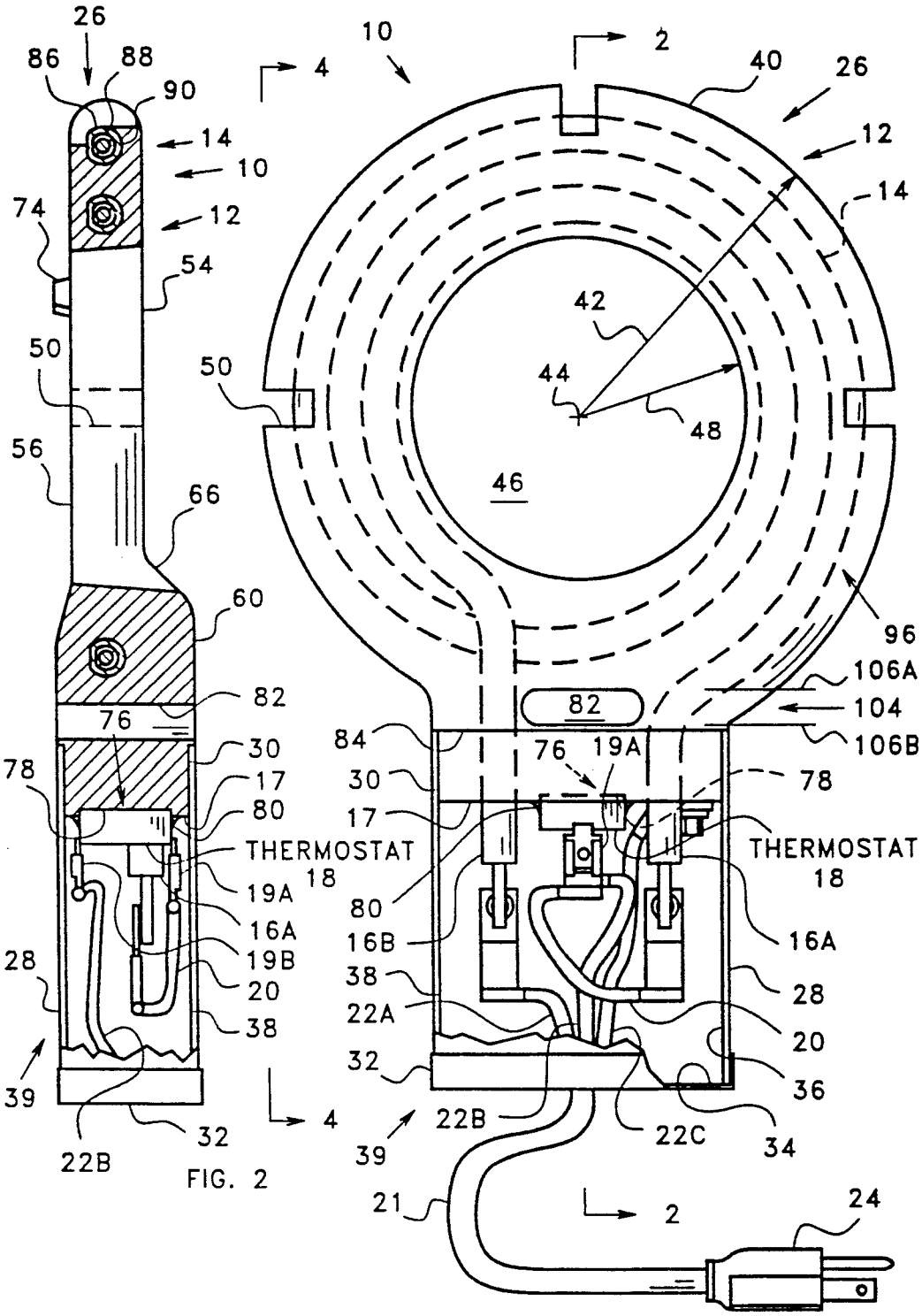
FIG. 1 is a top view of the electric heater of the present invention.
FIG. 2 is a cross section of the embodiment of FIG. 1, taken substantially as shown by section line 2—2 of FIG. 1.

Referring now to FIG. 1, an electric heater 10, that is submersible, includes a molded metal case or body 12 being constructed of aluminum alloy #319 or any aluminum alloy suitable for die casting; an elongated electrical heating element, 14 being molded within the molded case 12 and having first and second ends, 16A and 16B, that extend outwardly from a surface 17 of the molded case 12; a thermostatic switch 18 having first and second terminals, 19A and 19B, being bonded in heat-transferring proximity to the molded case 12 with the first terminal 19A connected to the first end 16A by a conductor 20; and a power cord 21 having a first electrical conductor 22A that is connected to the second end 16B, having a second electrical conductor 22B that is connected to the second terminal 19B of the thermostatic switch 18, having a third conductor 22C that is connected to the molded case 12, and having a power plug 24 that is connected to all three of the conductors 22A-22C of the power cord 21. Since aluminum alloys are well known for their high heat conductivity, and since the case 12 is molded over the heating element 14, it follows that the electric heater 10 includes a molded case 12 of high heat conductivity that is in heat-exchanging contact with the thermostat 14. Since aluminum alloys are well known for their high heat conductivity, and since the case 12 is molded over the heating element 14, it follows that the electric heater 10 includes a molded case 12 of high heat conductivity that is in heat-exchanging contact with the thermostat 14.

The molded case 12 and the heating element 14 combine to provide a heater subassembly 26. A plastic tube 28 is pressed over a reduced cross section heat-sensing end, or heat-sensing portion, 30 of the molded case 12. A drawn metal cap 32 is pressed over an end 34 of the plastic tube 28. An interior 36 of the plastic tube 28 is filled with a potting compound, or first heat-flow barrier, 38 thereby providing a protective cover 39 that seals the thermostatic switch 18, the ends 16A and 16B, the terminals 19A and 19B, and the conductors 22A-22C from moisture.

The molded case 12 of the heater subassembly 26 includes an outer periphery 40 that is generally circular at a first radius 42 about an axis 44, a circular opening 46 that is disposed about the axis 44 at a second radius 48, notches 50 that extend inwardly from the outer periphery 40, and the reduced cross section end 30.

Figure 4:
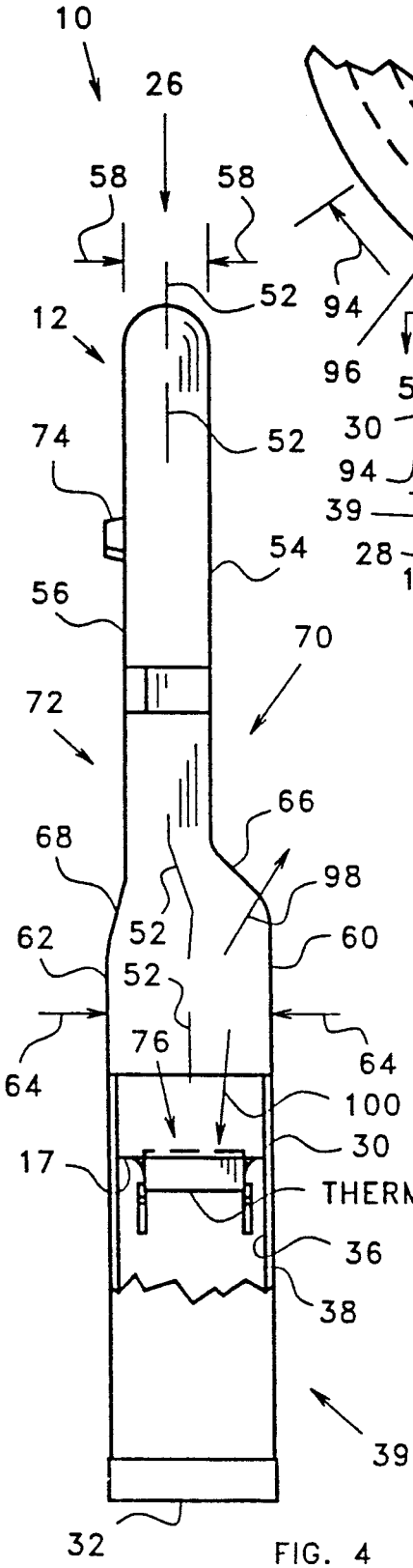
FIG. 4 is a side view of the embodiment of FIG. 1, taken substantially as shown by view line 4—4 of FIG. 1.

The molded case 12 further includes a joggled plane 52, as shown in FIG. 4. The joggled plane 52 is disposed substantially equidistant between first and second planar surface portions, 54 and 56, that enclose a first thickness 58, is disposed substantially equidistant between third and fourth planar surface portions, 60 and 62, that enclose a second thickness 64, and is disposed substantially equidistant between first and second transition surface portions, 66 and 68. Also, the molded case 12 includes a first surface 70 that includes the surface portions 54, 60, and 66, and that extends to both the joggled plane 52 and the reduced cross section end 30. In like manner, the molded case 12 has a second surface 72 that includes the surface portions 56, 62, and 68, and that extends to both the joggled plane 52 and the reduced cross section end 30.

The molded case 12 of the heater subassembly 26 shown in FIG. 4 further includes a pair of support lugs 74 that serve as feet to support the electric heater 10 above a surface of a tank, not shown, not a part of the present invention. Also, the molded case 12 shown in FIG. 1 includes a circular counterbore 76 having a planar bottom surface 78 that is a part of the surface 17. The thermostatic switch 18 is bonded in heat-receiving proximity to the planar bottom surface 78 by epoxy 80. The notches 50 are used to support the electrical heating element 14 in the molding operation and serve no purpose in the functioning of the electric heater 10.

In the embodiments of FIGS. 1 and 4, the radius 42 of the outer periphery 40 is 6.60 cm; the radius 48 of the circular opening 46 is 3.20 cm; the reduced cross section end 30 of the molded case 12 is 1.27 cm long, 5.41 cm wide, and 2.24 cm thick; the first thickness 58 of the molded case 12 is 1.32 cm; the second thickness 64 of the molded case 12 is 2.54 cm; and an elongated slot, or recess, or second heat-flow barrier, or opening, or passageway, 82 is 2.24 cm long and 0.64 cm wide. The elongated slot 82 is disposed 0.20 cm from an end 84 of the reduced cross section end 30.

Figure 3:
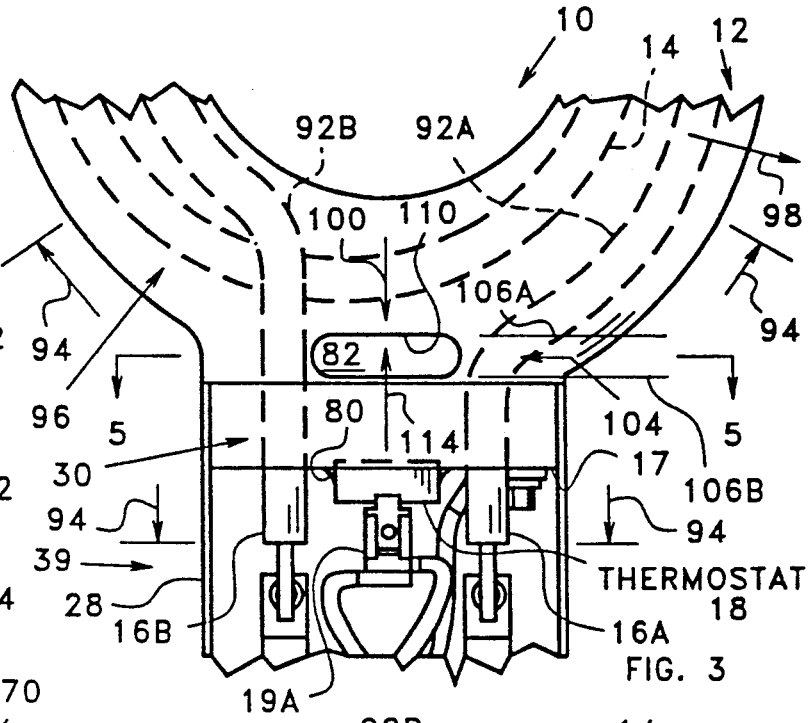
FIG. 3 is a partial top view of the present invention taken substantially the same as FIG. 1.

The heating element 14, being spirally coiled as shown in FIG. 1, includes a shield, or copper tube, 86 as shown in FIG. 2 that contains an insulation material 88 and a resistive heating element 90 which is disposed inside the insulation material 88. The heating element 14 further includes first and second cold portions, 92A and 92B, that extend 6.50 cm from the ends 16A and 16B by a distance 94, as shown in FIG. 3. Further, the resistive heating element 90 is intermediate of the cold portions 92A and 92B. Preferably, the power of the heating element 14 is between 50 and 1500 watts.

Referring now to FIGS. 3 and 4, in operations, a heat generating portion, or first portion, 96 of the molded case 12 produces heat, and the heat is transmitted via a first flow path 98 to the surfaces 70 and 72 of the molded case 12, and then on to a fluid, not shown. Also, heat from the heat generating portion 96 is transmitted via a second flow path 100 to the heat sensing portion 30. The thermostatic switch 18 senses the temperature of the heat sensing portion 30, and the thermostatic switch 18 controls the heating element 14 as a function of the temperature of the heat sensing portion 30.

In the present invention, as shown in FIG. 1, the heat generating portion 96 and the heat sensing portion 30 of the molded case 12 are separated by the slot 82, and the molded case 12 includes a heat-transmitting portion 104 that is disposed intermediate of the heat generating portion 96 and the heat sensing portion 30, and is further disposed intermediate of lines 106A and 106B.

Figure 6:
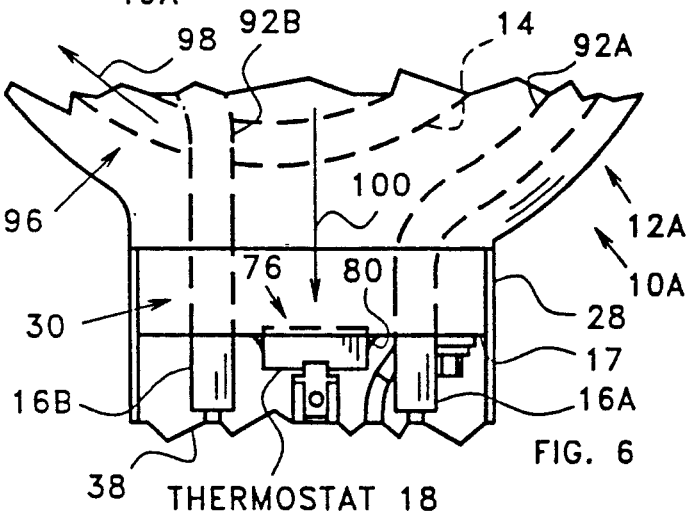
FIG. 6 is a partial top view taken substantially the same as FIG. 3 and showing a heater identical to the heater of FIGS. 1-5 except for omission of the elongated slot between the heating element and the thermostatic switch.

In early testing of an electrical heater 10A, two test units were made exactly like the electric heater 10 except with a body 12A that did not include the elongated slot 82, as shown in FIG. 6. One test unit included a 50 watt element, and the other included a 500 watt element. Both of the test units were placed in separate buckets of water and exposed to freezing temperatures.

Contrary to what would be expected, the 50 watt electrical heater kept the water in its bucket from freezing, but the 500 watt electrical heater did not prevent the water in the other bucket from freezing.

Referring to FIGS. 4 and 6, the reason is that in the higher wattage unit, due to the ultracompact construction of the electric heater 10A, the heat generating portion 96 transmitted heat so rapidly via the second flow path 100 to the heat sensing portion 30, that the thermostatic switch 18 shut off power to the heating element 14 before sufficient heat could be transmitted to the surfaces 70 and 72 via the first flow path 98. Further, heat from the mass of the portion 30 proximal to the thermostatic switch 18 did not flow readily to the surfaces 70 and 72 of the body 12A, so that the portion 30, retained heat for an extended period of time, thereby holding the thermostatic switch 18 in a "power off" condition.

However, in the present invention, as shown in FIG. 3 the elongated slot 82 serves as a heat barrier, reducing the rate of heat transfer from the heat generating portion 96 through the second flow path 100 to the heat sensing portion 30.

Figure 5:
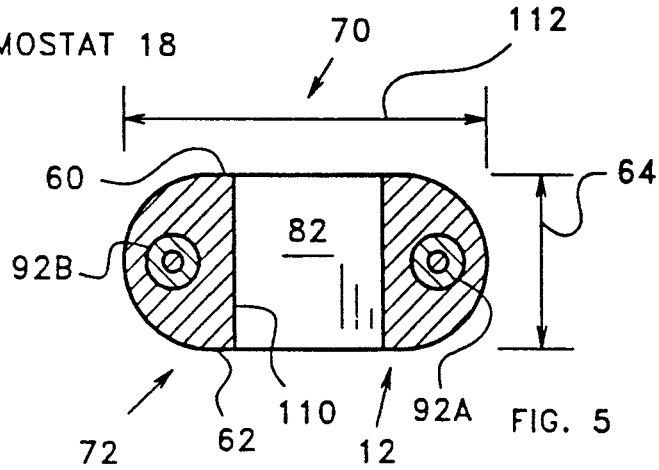
FIG. 5 is a cross section of the embodiment of FIG. 1, taken substantially as shown by view line 5—5 of FIG. 3.

For purposes of understanding the claims, the present invention includes means for reducing the rate of heat transfer from the heating element 14 through the molded case 12 to the thermostatic switch 18. The means for reducing the rate of heat transfer includes a barrier, and in the embodiment illustrated herein, the barrier includes the elongated slot 82, as shown in FIGS. 1, 2, 3, and 5. Or, this means for reducing the rate of heat transfer includes means for increasing the length-width ratio of the heat-transferring second flow path 100. The length-width ratio is increased by increasing the length of the slot 82 while maintaining the heat-transmitting portion 104 as disposed intermediate of lines 106A and 106B as shown in FIG. 1. The means for reducing the rate of heat transfer also includes a cooling surface, or elongated side, 110, and the cooling surface 110 is part of the elongated slot 82, as shown in FIG. 5.

As shown in FIG. 5, the present invention includes means for reducing the cross sectional area of the heat-transmitting portion 104 without reducing either a width 112 or the second thickness 64 between the surfaces 70 and 72. This means for reducing the cross sectional area includes the elongated slot 82.

Further, for purposes of understanding the claims, the means for reducing heat transfer includes the slot 82 that extends inwardly from the first surface 70. Preferably, as shown in FIG. 2, the recess 82 extends through the body 12 to the second surface 72.

In addition, as shown in FIG. 3, the present invention includes means 104 for transmitting heat from the heating element 14 to the thermostatic switch 18 at a first rate, means for transmitting heat from the thermostatic switch 18 to the fluid at a second rate, and means for increasing the ratio of the second rate to the first rate. This means for increasing the ratio of the second rate to the first rate includes a third heat-flow path 114 from the thermostatic switch 18 to the cooling surface 110, and the cooling surface 110 is part of the elongated slot 82.

For purposes of understanding the claims, the elongated slot provides means for reducing the rate of heat transfer from the heat generating portion 96 to the heat sensing portion 30; means for providing a barrier to heat transfer from the heat generating portion 96 to the heat sensing portion 30; means for cooling the portion 30 by the fluid via the cooling surface 110 and the third flow path 114; means for increasing the rate of heat transferred to the fluid while decreasing the rate of heat transferred to the heat sensing portion 30 from the heat generating portion 96; a method for transmitting heat from the heat sensing portion 30 to the fluid; a method for controlling the temperature of the heat sensing portion 30, and therefore controlling the heat generating portion 96; and a method for increasing the heat transmitted to the fluid versus the heat transmitted to the heat sensing portion 30.

As previously described, the thermostatic switch 18 is juxtaposed against the molded body 12; and a protective cover 39, which consists of a potting compound 38, is disposed over the thermostatic switch 18, thereby reducing thermal conductivity, or rate of heat transfer, from the thermostatic switch 18 to the heated fluid.

Therefore, because of the thermostatic switch 18 being juxtaposed against the molded body 12, relatively high thermal conductivity exists from the heating element 14 to the thermostatic switch 18; and, because of the potting compound 38, relatively low conductivity exists from the thermostatic switch 18 to the heated fluid, thereby resulting in the thermostatic switch 18 being unduly sensitive to the heat of the heating element 14.

Further, as previously described, the electric heater 10 of the present invention includes means, which preferably includes an elongated slot 82 that is interposed between the heating element 14 and the thermostatic switch 18, for reducing the rate of heat transfer from the heating element 14 to the thermostatic switch 18, thereby at least partially overcoming the reduction of thermal conductivity between the thermostatic switch 18 and the heated fluid, and thereby overcoming the excessive sensitivity of the thermostatic switch 18 to the heating element 14.

In the preceding descriptions of the various embodiments, not every element, nor every part of every element, has been described in conjunction with a particular embodiment. The reader should understand that, where the same numbers are shown in various drawings, the elements, and parts thereof, are the same as like-numbered parts which are described in conjunction with any other embodiment.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

INDUSTRIAL APPLICABILITY

The present invention is applicable for use in preventing water from freezing in large and small livestock watering tanks during cold weather, for maintaining the water in livestock watering tanks at a temperature that will increase the water consumption of animals being fattened for market, and for use in thermostatically controlled heating of various fluids.

What is claimed is:

1. An electric heater (10) for immersion into a fluid, which electric heater comprises:
   - a heating element (14) having first and second ends (16A and 16B);
   - a molded case (12) of high heat conductivity material, being in heat exchanging contact with said heating element, and enclosing said heating element;
   - a thermostatic switch (18) being in heat-receiving proximity to said molded case, and being operatively connected to one of said ends (16A) of said heating element;
   - an electrical conductor (22B) being operatively connected to said thermostatic switch;
   - another electrical conductor (22A) being operatively connected to the other of said ends (16B) of said heating element;
   - a first heat-flow barrier (38) being disposed intermediate of said thermostatic switch and said fluid to be heated; and
   - means, comprising a second heat-flow barrier (82) intermediate of said heating element and said thermostatic switch, for reducing the rate of heat transfer from said heating element through said molded case to said thermostatic switch.

2. An electric heater (10) as claimed in claim 1 in which said first heat-flow barrier (38) comprises a protective cover (39) over said thermostatic switch (18) that reduces thermal conductivity between said fluid to be heated and said thermostatic switch.

3. An electric heater (10) as claimed in claim 1 in which said second heat-flow barrier (82) includes a cooling surface (110) that is disposed transversely between said heating element (14) and said thermostatic switch (18).

4. An electric heater (10) as claimed in claim 1 in which said molded case (12) includes a portion (104) intermediate of said heating element (14) and said thermostatic switch (18) having a width (112), and having both a first surface (70) and a second surface (72); and
   - said second heat-flow barrier (82) includes means for reducing the cross sectional area of a part of said portion (104) without reducing either said width (112) or a second thickness (64) between said first and second surfaces (70 and 72).

5. An electric heater (10) as claimed in claim 1 in which said molded case (12) includes a portion (104) intermediate of said heating element (14) and said thermostatic switch (18) having a width (112), and having both a first surface (70) and a second surface (72); and
   - said second heat-flow barrier (82) includes means for increasing the length-width ratio of a second flow path (100) for the heat transfer between said heating element and said thermostatic switch without reducing either said width or a second thickness (64) which is the distance between said first and second surfaces (70 and 72).

6. An electric heater (10) as claimed in claim 1 in which said molded case (12) includes a portion (104) intermediate of said heating element (14) and said thermostatic switch (18) having a width (112), and having both first and second surfaces (70 and 72); and
   - said second heat-flow barrier comprises a recess (82) that is disposed in said portion, and that extends inwardly from one of said surfaces (70 or 72).

7. An electric heater (10) as claimed in claim 1 in which said molded case (12) includes a portion (104) intermediate of said heating element (14) and said thermostatic switch (18) having a width (112), and having both a first surface (70) and a second surface (72); and
   - said second heat-flow barrier comprises an opening (82) that extends from said first surface (70) through said second surface (72).

8. An electric heater (10) as claimed in claim 1 in which said molded case (12) includes a portion (104) intermediate of said heating element (14) and said thermostatic switch (18) having a width (112), and having both a first surface (70) and a second surface (72); and
   - said second heat-flow barrier comprises an elongated slot (82) with an elongated side (110) thereof disposed to maximize reduction of heat transfer from said heating element to said thermostatic switch.

9. An electric heater (10) for heating fluids, which comprises:
   - an elongated heating element (14) being in a generally geometrical shape with first and second ends (16A and 16B) proximal to one another;
   - a molded metal case (12) of high heat conductivity material, being in heat exchanging contact with said heating element, and enclosing said elongated heating element except for said ends extending outwardly from a surface (17) of said metal case;
   - a thermostatic switch (18) being disposed between said ends, being bonded to said surface of said molded case, and being electrically connected to one of said ends (16A) of said elongated heating element;
   - a first electrical conductor (22A) being electrically connected to the other of said ends (16B) of said elongated heating element;
   - a second electrical conductor (22B) being electrically connected to said thermostatic switch;
   - a protective cover (39), comprising a potting compound (38), being disposed over said thermostatic switch for reducing thermal conductivity between a heated fluid and said thermostatic switch; and
   - means (82) intermediate of said heating element and said thermostatic switch for reducing the rate of heat transfer from said elongated heating element through said molded case to said thermostatic switch.

10. An electric heater (10) as claimed in claim 9 in which said means for reducing the rate of heat transfer (82) comprises a barrier that is disposed intermediate of said elongated heating element (14) and said thermostatic switch (18).

11. An electric heater (10) as claimed in claim 9 in which said means for reducing the rate of heat transfer (82) comprises a passageway that extends through said molded case (12) intermediate of said elongated heating element (14) and said thermostatic switch (18).

12. An electric heater (10) as claimed in claim 9 in which said means for reducing the rate of heat transfer (82) comprises a barrier that is disposed intermediate of said elongated heating element (14) and said thermostatic switch (18); and said barrier comprises a passageway that extends through said molded case (12) intermediate of said elongated heating element and said thermostatic switch.

13. An electric heater (10) as claimed in claim 9 in which said means for reducing the rate of heat transfer (82) comprises a recess that is disposed intermediate of said elongated heating element (14) and said thermostatic switch (18); and said means for reducing the rate of heat transfer further comprises a cooling surface (110) that is disposed transverse to a second flow path (100) for heat transfer between said elongated heating element and said thermostatic switch.

14. A method for electrically heating a fluid, which method comprises:

a) encasing an electrical heating element in heat exchanging contact in a molded body of high heat conductivity material;

b) using said heating element to electrically heat a first portion of said molded body;

c) transmitting heat from said first portion of said molded body to a second portion of said molded body that is integral with said first portion;

d) controlling said using step as a function of the temperature of said second portion;

e) providing a first barrier to reduce heat transmission between said second portion and said fluid; and f) providing a second barrier intermediate of said first and second portions to reduce said transmission of heat from said first portion to said second portion, thereby compensating for said reduction in heat transmission between said second portion and said fluid.

15. An electric heater (10) for immersion in fluid, which electric heater comprises:

an electrical heating element (14);

a molded body (12) of high heat conductivity material, being in heat exchanging contact with said heating element, and encasing said electrical heating element except for ends (16A and 16B) thereof;

a thermostatic switch (18) being in heat-receiving juxtaposition to said molded body;

a first heat-flow barrier (38), comprising a potting compound, being disposed distal from said heating element and being interposed between said thermostatic switch and said fluid to be heated; and a second heat-flow barrier (82) being disposed in said molded body intermediate of said heating element and said thermostatic switch.

16. An electric heater (10) as claimed in claim 15 in which said second heat-flow barrier comprises a recess (82) in said molded body (12) that is disposed intermediate of said heating element (14) and said thermostatic switch (18).

17. An electric heater (10) as claimed in claim 15 in which said second heat-flow barrier comprises a recess (82) in said molded body (12) that is disposed intermediate of said heating element (14) and said thermostatic switch (18); and said recess includes a cooling surface (110) that provides a heat-flow path (114) between said thermostatic switch and said fluid.

* * * * *